US007916104B2

(12) United States Patent
Hewlett et al.

(10) Patent No.: US 7,916,104 B2
(45) Date of Patent: Mar. 29, 2011

(54) INCREASED INTENSITY RESOLUTION FOR PULSE-WIDTH MODULATION-BASED DISPLAYS WITH LIGHT EMITTING DIODE ILLUMINATION

(75) Inventors: Gregory James Hewlett, Richardson, TX (US); Donald B. Doherty, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1440 days.

(21) Appl. No.: 11/140,048

(22) Filed: May 27, 2005

(65) Prior Publication Data

US 2006/0268002 A1 Nov. 30, 2006

(51) Int. Cl.
*G09G 3/34* (2006.01)

(52) U.S. Cl. ..... 345/85; 345/30; 345/204

(58) Field of Classification Search ..... 345/697, 345/7–9, 32, 204–215, 81–87; 353/49, 82
See application file for complete search history.

(56) References Cited

U.S. PATENT DOCUMENTS 6,057,816 A * 5/2000 Eckersley ..... 345/85
6,188,426 B1 * 2/2001 Nakamura ..... 347/239
6,377,236 B1 * 4/2002 Karamoto ..... 345/102
6,535,187 B1 * 3/2003 Wood ..... 345/84
6,775,049 B1 * 8/2004 So ..... 359/291
6,965,367 B2 * 11/2005 Tanaka et al. ..... 345/102
7,518,570 B2 * 4/2009 Arnold, II ..... 345/32
2002/0126479 A1 * 9/2002 Zhai et al. ..... 362/244
2002/0172039 A1 * 11/2002 Inditsky ..... 362/231
2004/0263500 A1 * 12/2004 Sakata ..... 345/204
2005/0052376 A1 * 3/2005 Shivji ..... 345/82

* cited by examiner

*Primary Examiner* — Alexander Eisen
*Assistant Examiner* — Christopher E Leiby
(74) *Attorney, Agent, or Firm* — Charles A. Brill; Wade James Brady, III; Frederick J. Telecky, Jr.

(57) ABSTRACT

A method for increasing intensity resolution (bit-depth) using LED illumination. A preferred embodiment comprises determining a display time for a bit to be displayed on a display system, with the display time being based upon a weighting of the bit. If the display time is less than a minimum display time of the display system, then a light modulator and light source modulation are to be used to display the bit. If the display time is equal to or greater than the minimum display time, then a light modulator is to be used to display the bit. The use of a light source that can switch at a faster rate than the light modulator can change states and/or a light source that can produce light at multiple intensities can permit the display of less light and thereby increase the bit-depth of the display system.

23 Claims, 6 Drawing Sheets

INCREASED INTENSITY RESOLUTION FOR PULSE-WIDTH MODULATION-BASED DISPLAYS WITH LIGHT EMITTING DIODE ILLUMINATION

TECHNICAL FIELD

The present invention relates generally to a system and method for video display systems, and more particularly to a system and method for increasing intensity resolution (bit-depth) using LED illumination.

BACKGROUND

In a typical video display system, images can be created by either emitting or modulating light. The light forms picture elements (pixels), which, when viewed together with other pixels, form an image. The pixels in an image will typically have a variety of colors and/or intensities, with image quality being dependent upon a number of different intensity levels the pixels are capable of displaying. A binary spatial light modulator (binary SLM), such as a binary micromirror device (DMD), is digital in nature and is not capable of emitting light with different intensity levels. However, there may be other SLMs that can be digital in nature but are not binary. Instead, the binary SLMs will typically rely on a pulse width modulation (PWM) scheme to create light at various intensity levels by rapidly turning a light modulator on and off. The integration of the rapidly switching light by the eye provides an illusion of multiple intensity levels.

Being mechanical devices, there is a limit to how rapidly the light modulator can be turned on and off. For example, in a DMD, the time that is required to turn the light modulator (a mirror in the DMD) on and off corresponds to moving a mirror from the off state to an on state and then back to the off state. This time can be dominated by a time that the mirror (micromirror) takes to settle to a stable state after moving. This translates to a minimum amount of light that can be emitted within a single frame time. The minimum amount of light corresponds to a lowest intensity level that can be produced by the binary SLM and can be referred to as a bit-depth of the video display system. In general, the smaller the minimum amount of light, the higher the bit-depth and the finer the image quality produced by the video display system.

One technique that can be used to reduce the minimum amount of light produced by the binary SLM is to make use of a neutral density filter (NDF) to modulate the light for the short duration light pulses. The NDF can have different densities and therefore can attenuate the light to different levels.

Another technique that can be used to reduce the minimum amount of light produced by the binary SLM is to use dynamic aperture technology. Dynamic aperture technology makes use of adjustable apertures to reduce the intensity of the light.

One disadvantage of the prior art is that the use of the NDF causes loss of light during the entire time of reduced illumination. This time is far greater than the switching on/off time of the mirror. This loss of light results in a reduction of overall system brightness.

A second disadvantage of the prior art is that the use of the NDF or the dynamic aperture technology to modulate light amplitude can require modifications to existing binary SLM products and technologies, which can require significant redesign and redevelopment. This can lead to the expenditure of a large amount of time and money.

A third disadvantage of the prior art is that both the NDF and the dynamic aperture technology techniques are mechanical techniques, which also have physical limits on a minimum amount of light that can be emitted. Therefore, it may not be possible to reduce the minimum light intensity to a desired level if the physical limits are too high. Additionally, mechanical techniques may not be able to provide a desired level of flexibility when it comes to exactly producing a needed level of light.

SUMMARY OF THE INVENTION

These and other problems are generally solved or circumvented, and technical advantages are generally achieved, by preferred embodiments of the present invention which provides a method for increasing intensity resolution using LED illumination.

In accordance with a preferred embodiment of the present invention, a method for displaying a bit in a spatial light modulator display system is provided. The method includes determining a display time for the bit based upon a weighting of the bit and using a light modulator to display the bit in response to a determination that the display time is substantially equal to or greater than a minimum display time. The method also includes using the light modulator and light source modulation to display the bit in response to a determination that the display time is less than the minimum display time.

In accordance with another preferred embodiment of the present invention, a system for displaying video images is provided. The system includes a spatial light modulator and a rapid switching light source that can optically illuminate the spatial light modulator. The spatial light modulator creates images made up of pixels by setting each light modulator in an array of light modulators into a state matching a corresponding pixel value, while the rapid switching light source is capable of switching at a faster rate than a rate of state switching by the spatial light modulator.

An advantage of a preferred embodiment of the present invention is that the use of LEDs for illumination can mean that LEDs can simply replace projector lamps in existing binary SLM designs. Therefore, implementation of the present invention can be achieved with very little modification to existing designs.

A further advantage of a preferred embodiment of the present invention is that when used in conjunction with a light modulator (for example, a mirror), the ability of the LEDs to rapidly turn on and off and produce light in a wide range of intensities can lead to a binary SLM with the capability to produce a wide range of light intensities. This can yield a binary SLM with an increased bit-depth.

Yet another advantage of a preferred embodiment of the present invention is that the ability to shorten the minimum amount of light producible by a binary SLM display system by using techniques other than shortening the light modulator switching time can result in a relaxation of design criteria and performance characteristics for the light modulators. The relaxation of the design criteria and performance characteristics can permit the use of lower cost and better tested manufacturing techniques and materials to create the light modulators, for example. Furthermore, the light modulators themselves may not have to be pushed as close to their performance limits to meet desired performance characteristics. Therefore, the light modulators may be cheaper and more reliable, as well as having higher manufacturing yields.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely a binary SLM display system that makes use of mirrors as light modulators. The invention may also be applied, however, to other binary SLM display systems, wherein a light modulator is used to attenuate light intensity arising from a fixed light source. Examples of these binary SLM display systems can be display systems making use of liquid crystal display technology, liquid crystal on silicon technology, deformable mirror technology, actuated mirror technology, and so forth.

Figure 1:
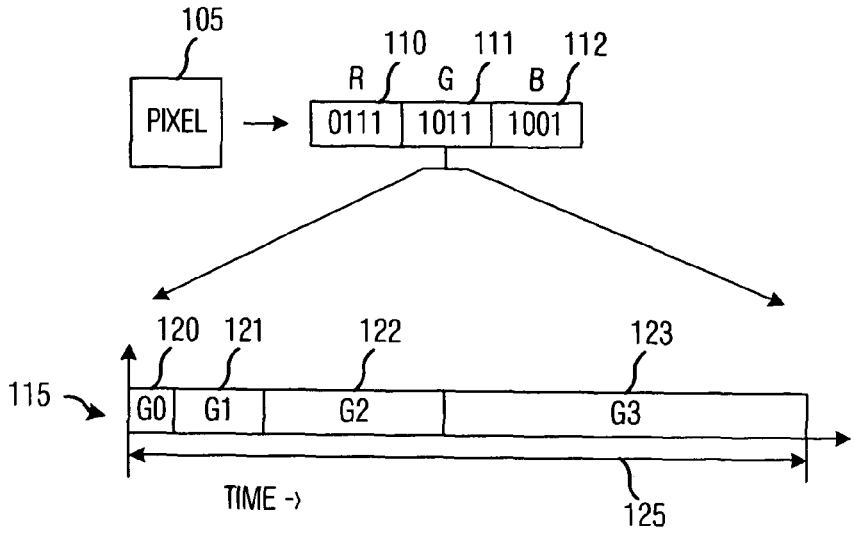
FIG. 1 is a diagram of a pixel that is broken down into its RGB component values and a timing diagram for displaying the G component values of the pixel.

With reference now to FIG. 1, there is shown a diagram illustrating a pixel 105 and an exemplary technique that can be used to display the pixel 105 on a display screen of a binary SLM display system. In computer applications, a pixel, such as the pixel 105, of a color image can be described by three values. The three values can represent amounts of three basic colors (red, green, and blue) present in the pixel. The three values are commonly denoted R (for red), G (for green), and B (for blue) and collectively are referred to as the RGB color space. Examples of other techniques to describe a pixel can include CYMK (cyan, yellow, magenta, and black), HSB (hue, saturation, and brightness), and LAB (luminance and chromatic components).

A numeric value can represent an amount of red, green, or blue present in the pixel 105. For example, as displayed in FIG. 1, the pixel 105 can be represented in the RGB color space, where each value is represented as a four-bit binary number, with a red component equal to 7 (binary 0111 (box 110)), a green component equal to 11 (binary 1011 (box 111)), and a blue component equal to 9 (binary 1001 (box 112)). The binary representation of the RGB values, for example, the green component, can be used by light modulators in the binary SLM display system to graphically display the pixel 105 on a display screen.

As shown in FIG. 1, the green component 111 of the pixel 105 can be represented in binary form as 1011. A light modulator, such as a micromirror, can be provided with the binary representation of the green component 111, for example, in a bit-wise fashion and depending upon the value of the bit, the light modulator can be placed in a corresponding on or off state. For example, the binary form of the green component 111 can be represented as G0=1, G1=1, G2=0, and G3=1, wherein bit G0 is the bit with the smallest weight (commonly referred to as being a least significant bit) and bit G3 is the bit with the largest weight (commonly referred to as being a most significant bit). In addition to determining the state of the light modulator, the bit (more precisely, the weight of the bit) determines a period of time that the light modulator remains in the state. For instance, bit G0 could have the light modulator in desired state for time T0 and bit G3 could have the light modulator in desired state for time T3, wherein time T3 is $2^3$ times longer in duration than time T0. In general, for each increase in bit weight, there is a two times increase in the time that the light modulator holds the desired state. Although the above example displays a binary (power of two) weighting system for the bits of the RGB components of the pixel 105, weighting systems other than binary can be used. The example of the binary weighting system should not be construed as being limiting to the spirit of the invention.

The pixel information to be displayed for a single pixel may be in the binary form of the input data being provided to the binary SLM display system. However, the pixel information to be displayed for a single pixel may also be in a binary form that is a result of a transformation to a non-binary weighting of each bit in the representation. This transformation may occur within the binary SLM display system. For example, the binary form for the green component 111 in the system input data may be a standard four-bit binary weighting. In such a representation, the bit weights would be 1, 2, 4, and 8, respectively. Thus, a decimal 10 value would correspond to a binary representation of 1010 ($2^3+2^1$). This input data, however, could be transformed into a six-bit weighting system with weights 1, 1, 2, 2, 4, and 5, for example. So, the same decimal 10 value could be represented as 011111 (4+2+2+1+1).

The time T0, which is a period of time that a light modulator maintains its state for the least significant bits of the RGB component values for each pixel being displayed, is also often a minimum state switch time for the light modulator being used in the binary SLM display system. For example, in a binary SLM display system using digital micromirror devices, a minimum amount of time that it takes to switch a micromirror from an off state to an on state and back to an off state is often assigned to time T0. The time T0 then corresponds to a minimum amount of light intensity usable to illuminate a single pixel.

A trace 115 illustrates time allocated to each bit of an exemplary green (G) component of the RGB component values of the pixel 105 by a light modulator. Since bit G0 represents the least significant bit of the green component of the pixel 105, a minimum amount of time, T0, is used to display the bit G0. This is shown in the trace 115 as block 120, labeled "G0." Bit G1 is referred to as being a second least significant bit, and since bit G1 is twice as significant as bit G0, the light modulator should use twice the time to display bit G1 as it did displaying bit G0. This is shown in the trace 115 as block 121, labeled "G1." Similarly, bits G2 and G3 are displayed with display times four times and eight times as long as the time to display bit G0 (shown as block 122, labeled "G2," and block 123, labeled "G3"), respectively. Again, the example discusses a binary weighting system only for discussion purposes and does not limit the present invention to the use of a binary weighting system.

While the above discussion presents specific examples of the RGB components of a single pixel in an image that is to be displayed by the binary SLM display system, the actual value of the bits being displayed does not actually factor into the behavior of the binary SLM display system. Regardless of the fact that a single bit of a component value of a pixel is a binary one or a binary zero, the binary SLM display system will dedicate a predetermined amount of time to the display of the bit (the amount of time being determined by a weight assigned to the bit) and provide the exact same sequence of instructions to each of the light modulators in the display system.

For a given image in an image stream, there is a time value, referred to as a frame time, within which the binary SLM display system must display all graphical information making up the image. For example, for an image containing the pixel 105, the binary SLM display system must display all four bits representing the green component of the pixel 105, as well as the bits representing the red and blue components of the pixel 105, within the time span (shown as interval 125) that is less than the frame time. If the frame time is long compared to the number of bits that needs to be displayed, then it can be a relatively simple task to display all of the bits. In this case, it may be possible to scale up the display times for each bit to increase image intensity. However, if the number of bits is large, it may be possible that the time needed to display all of the bits will exceed the frame time. In this case, it may be necessary to reduce the time allocated to the display of certain bits. However, it may not be possible to reduce the time allocated to the display of the least significant bit if the minimum amount of time is already being used to display the least significant bit.

Figure 2:
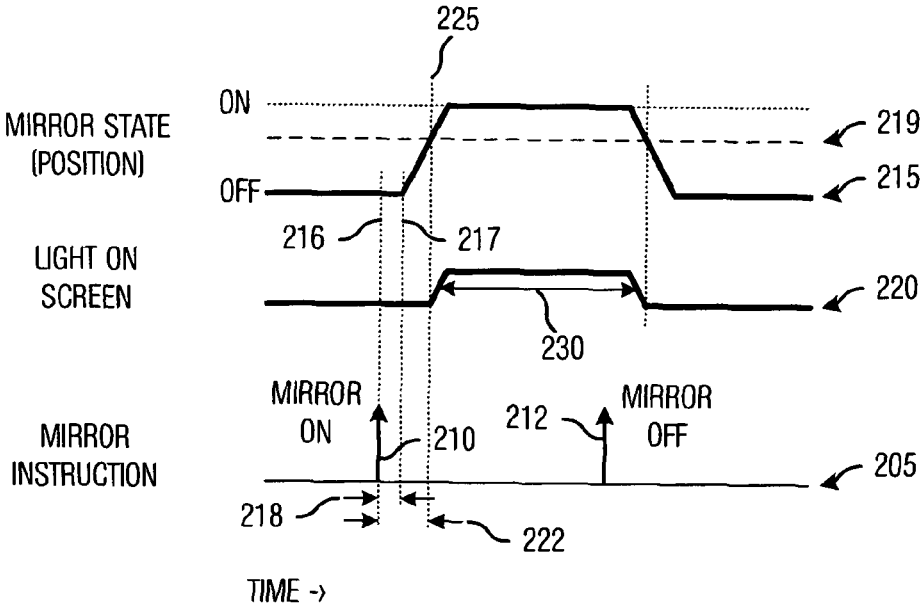
FIG. 2 is a timing diagram of the function of a binary SLM display system in response to control instructions.

With reference now to FIG. 2, there is shown a diagram illustrating the function of a binary SLM display system in response to control instructions with a plurality of traces, wherein the binary SLM makes use of micromirrors to modulate a light. As shown in FIG. 2, a first trace 205 illustrates micromirror instructions issued by the binary SLM display system. At a first time, a first instruction 210 instructs the micromirror to move to an "ON" position and at a second time, a second instruction 212 instructs the micromirror to move to an "OFF" position. A second trace 215 illustrates micromirror state (position) as a function of time. Since the micromirror is a mechanical device, there is a certain amount of inertia that must be overcome prior to the micromirror being able to move. At the first time, when the first instruction 210 is issued, indicated by a first vertical line 216, the micromirror can begin to move, but due to inertia, the micromirror does not begin to move until a later time, indicated by a second vertical line 217. A time between when the first instruction 210 is issued and when the micromirror actually begins to move is shown as interval 218. The second trace 215 is an idealized representation of the movement of the micromirror and does not display any ringing, vibration, or so forth that may actually be present in the movement of the micromirror.

Once the micromirror begins to move towards the "ON" position (at a time indicated by the second vertical line 217), the micromirror continues to move until it moves to a position consistent with being in an "ON" state. Once again, the second trace 215 does not display any over-travel, ringing, or so forth that may be present in the movement of the micromirror as it comes to a stop in the "ON" state. Once the micromirror passes a certain position along its movement path that is prior to it coming to a stop in the "ON" state, light reflecting off the micromirror can begin to show on a display screen. This micromirror position is shown in FIG. 2 as horizontal line 219.

A third trace 220 illustrates light present on the display screen, wherein the light originates from light that is reflected from the micromirror whose movement is displayed in the second trace 215. The third trace 220 shows that until the position of the micromirror passes the position denoted by the horizontal line 219, no light (or very little light due to ambient light) is present on the display screen. Once the micromirror passes the position shown as horizontal line 219 where some reflected light from the micromirror begins to show on the display screen at a time denoted by vertical line 225, the light present on the display screen begins to increase. The light on the display screen will continue to increase until the micromirror stops in the "ON" state and a maximum amount of reflected light is displayed on the display screen. A time between when the micromirror "ON" instruction 210 is issued and when the light actually begins to appear on the display screen is shown as interval 222. A complementary behavior is seen when the micromirror moves to an "OFF" state and the light on the display screen decreases until the micromirror passes the position where no light reflecting off the micromirror appears on the display screen.

Due to physical limitations such as inertia, vibrations, overshooting, ringing, and so forth, there is a minimum amount of time required for the micromirror to switch from the "OFF" state to the "ON" state and back to the "OFF" state. This minimum amount of time can correspond to a physical minimum amount of light displayed on a display screen. The physical minimum amount of time (physical minimum display time) for a binary SLM display system using a micromirror can be defined as the amount of time that elapses for a micromirror to switch from the "OFF" state to the "ON" state and back to the "OFF" state when micromirror instructions to move the micromirror to an "ON" state and then to an "OFF" state are issued as rapidly as possible, and is shown in FIG. 2 as interval 230. The interval 230 is commonly referred to as an effective light time (ELT). However, for a given binary SLM display system, the minimum amount of time (minimum display time) of the binary SLM display system may not be the same as the physical minimum amount of time. The minimum amount of time may be longer than the physical minimum amount of time due to design considerations, which must take into consideration factors such as system longevity, system reliability, frame time, number of bits to display, and so forth. It may be possible for the physical minimum amount of time to be equal to the minimum amount of time, but not necessarily.

With the binary SLM display system as described, the minimum amount of time (and its attendant minimum amount of light) corresponds to the least significant bit of a given RGB value of a given pixel. The $\log_2$ of the ratio of this time value to the total time of all bits on for a given display color is referred to as being the bit-depth of the binary SLM display system for the given display color. For example, if this ratio is 1/256, the bit depth is eight (8). It is not possible to produce less light (increase the bit-depth) without the addition of additional hardware and software to the binary SLM display system, such as using the prior art techniques of neutral density filters and adaptive aperture technology. However, there is often a desire to reduce this minimum amount of time or the minimum amount of light or both to improve the quality of images displayed by the binary SLM display system, since there can be a corresponding increase in image quality when there is an increase in image bit-depth.

Figure 3:
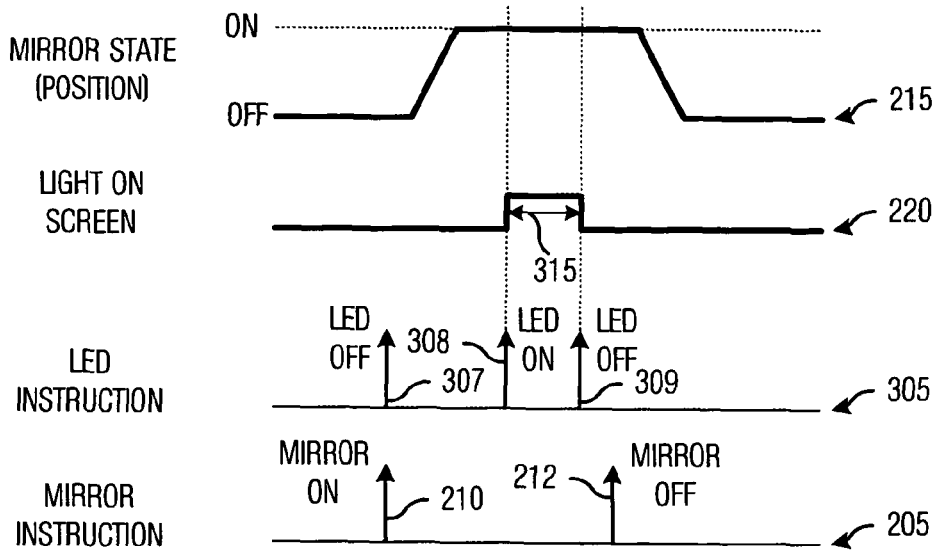
FIG. 3 is a timing diagram of the function of a binary SLM display system, wherein a rapid switching light source is used to change the bit-depth of the binary SLM display system, according to a preferred embodiment of the present invention.

With reference now to FIG. 3, there is shown a diagram illustrating the function of a binary SLM display system, wherein a rapid switching light source is used to change the bit-depth of the binary SLM display system by shortening the ELT of the display system, according to a preferred embodiment of the present invention. In addition to using the light modulator (for example, a movable micromirror) to control when a pixel is displayed on a display screen, it may also be possible to actually turn a light source on and off to control the display of the pixel on the display screen. In a typical binary SLM display system, high-intensity light sources are used to provide lighting. However, these high-intensity lights typically have very long cycle times when they are turned on and off, on the order of seconds or minutes. This prohibits the use of turning the lights on and off as a way of controlling the display of the pixel on the display screen. However, it is possible to rapidly turn a light-emitting diode (LED) on and off. A typical LED can be turned on or off in less than a micro-second. This can result in a very short ELT. Although reference is made to a singular LED, it is possible for the binary SLM display system to make use of a plurality of LEDs. For example, a plurality of LEDs arranged in an array-like manner can be used in place of a single LED. Additionally, the plurality of LEDs may contain LEDs of different colors, such as an array of LEDs made up of white LEDs, red LEDs, green LEDs, blue LEDs, and so on.

As shown in FIG. 3, the first trace 205 illustrates micromirror instructions as issued by the binary SLM display system. The binary SLM display system issues the first instruction 210 to move the micromirror to an "ON" position and the second instruction 212 to move the micromirror to an "OFF" instruction. The second trace 215 illustrates graphically the state (position) of the micromirror as a function of time and the third trace 220 illustrates light present on the display screen.

A fourth trace 305 illustrates LED (light) instructions as issued by the binary SLM display system. The binary SLM display system can issue at least two types of LED instructions, turn LED "ON" and turn LED "OFF." To ensure that no unintended light is reflected onto the display screen, a first LED instruction 307 is issued to turn LED "OFF." Although as shown in FIG. 3 the first LED instruction 307 is issued at approximately the same time as the first instruction 210 to move the micromirror to an "ON" position, the first LED instruction 307 may be issued at any time as long as the LED is off prior to the micromirror actually assuming the "ON" position. A second LED instruction 308 and a third LED instruction 309 can be used to turn the LED "ON" and then "OFF" for a desired amount of time. Since the micromirror was already in the "ON" position (from instruction 210), the light from the LED is displayed on the display screen for a time span (shown as highlight 315) that is substantially equal to the time between the second LED instruction 308 and the third LED instruction 309. Since the time to turn the LED on and off is short (on the order of less than a micro-second), light immediately appears (and disappears) from the display screen as the second LED instruction 308 (and the third LED instruction 309) is issued. The use of the LED light source can permit the binary SLM display system to generate light with shorter durations than with a light source that cannot rapidly switch on and off and therefore increase its bit-depth.

Figure 4:
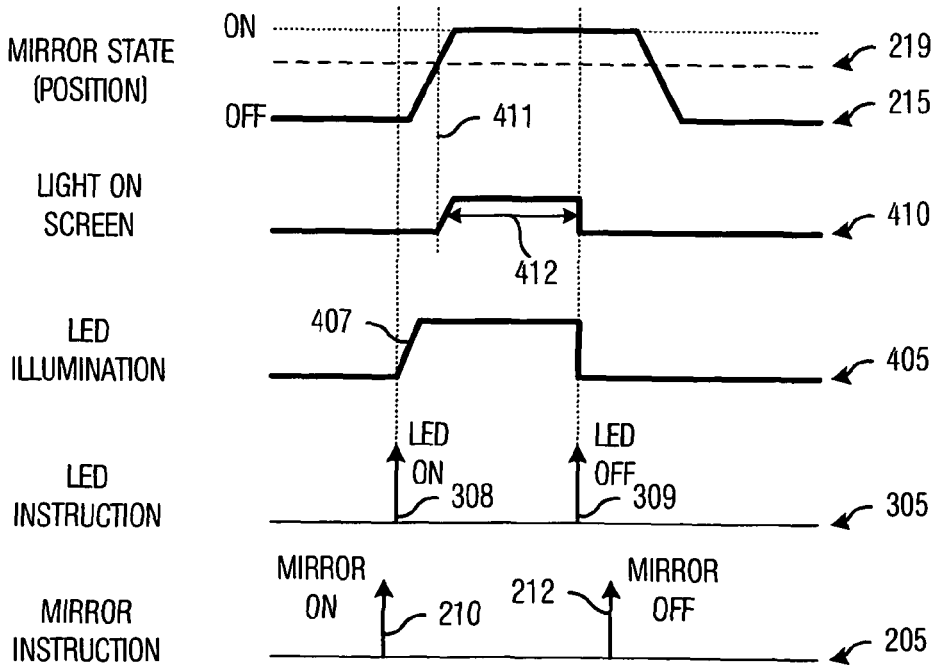
FIG. 4 is a timing diagram of the function of a binary SLM display system, wherein a rapid switching light source and a light modulator are used in conjunction to change the bit-depth of the binary SLM display system, according to a preferred embodiment of the present invention.

With reference now to FIG. 4, there is shown a diagram illustrating the function of a binary SLM display system, wherein a rapid switching light source and a light modulator are used in combination to change the bit-depth of the binary SLM display system by shortening the ELT of the display system, according to a preferred embodiment of the present invention. It is possible that current drivers for the LED may be a limiting factor in the ELT, for example, there may be a limit to the rate of change in the current that the current drivers can provide to the LED during the LED turn on transition. If this is the case, then the light produced by the LED may increase at a relatively slow rate (compared to a light turn off time, for example). Furthermore, the behavior of the LED while being turned on may be unstable or unpredictable. In these situations (and perhaps others), it can be possible to use the light modulator, such as a micromirror, in conjunction with the LED to shorten the ELT. The turn on behavior of the LED can be referred to as being undesirable.

A first trace 205 illustrates micromirror instructions as issued by the binary SLM display system and a second trace 215 illustrates the micromirror state (position) as a function of time. A third trace 305 illustrates LED instructions as issued by the binary SLM display system. Due to a relatively slow LED turn on rate, the second LED instruction 308 is issued prior to the micromirror being moved into the "ON" state. The LED may have already been on from displaying an earlier bit. A scheduler (referred to as a sequence controller) can insert proper instructions to control LED state, mirror state, and so forth, and if the LED was already on from displaying an earlier bit, the sequence controller may not have inserted the second LED instruction 308. However, depending upon binary SLM display system implementation, an instruction to turn the LED on may have no effect on the LED if it is already on. In this situation, the presence of the second LED instruction 308 is substantially harmless. Since an extended amount of time may elapse between the instruction 210 to turn the micromirror "ON" to when the micromirror actually moves into the "ON" state, the second LED instruction 308 can be issued at anytime such that the LED will be on prior to the micromirror moves into the "ON" state.

A fourth trace 405 illustrates LED illumination. Since the LED turn on rate is slow, a curve with a positive slope 407 is used to indicate the increasing illumination of the LED. A fifth trace 410 illustrates light on the display screen. Although the LED begins to produce light at a time prior to a time when light begins to appear on the screen, since the micromirror has not moved into the "ON" state, light from the LED is not reflected onto the display screen. As the micromirror moves into the "ON" state, it passes the position wherein some of the light reflected from the micromirror begins to show on the display screen. This position is indicated on the second trace 215 as the horizontal line 219 (a vertical line 411 indicates the timing relationship). The ELT of the binary SLM display system is shown as interval 412.

While the current driver may be a limiting factor on the turn on of the LED, it may not be a limiting factor on the turn off of the LED. As shown in FIG. 4, when the third LED instruction 309 is issued to turn off the LED, the light produced by the LED almost immediately turns off and this is reflected in the light shown on the display screen.

Figure 5:
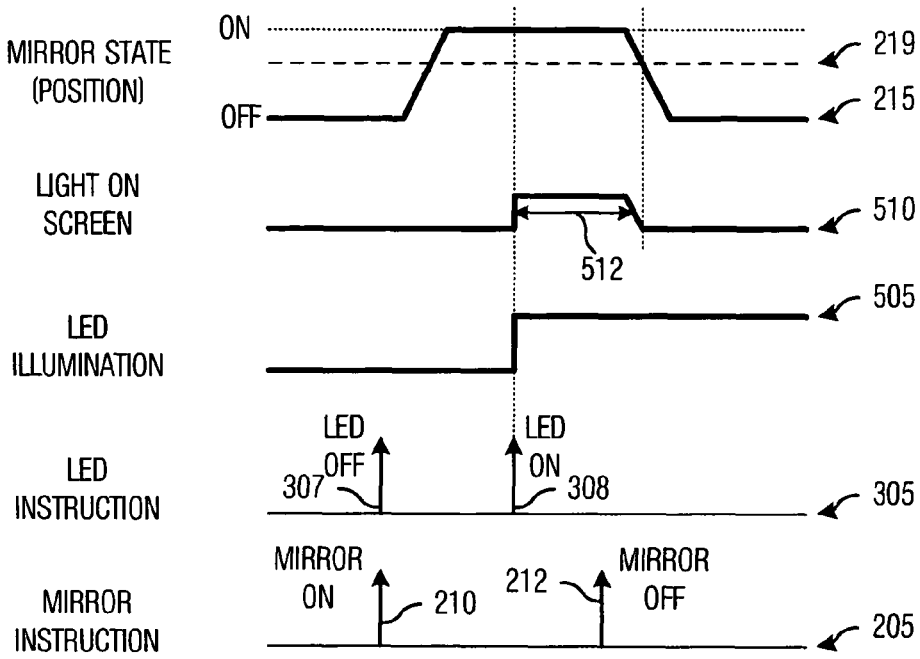
FIG. 5 is a timing diagram of the function of a binary SLM display system, wherein a rapid switching light source and a light modulator are used in conjunction to change the bit-depth of the binary SLM display system, according to a preferred embodiment of the present invention.

With reference now to FIG. 5, there is shown a diagram illustrating the function of a binary SLM display system, wherein a rapid switching light source and a light modulator is used in combination to change the bit-depth of the binary SLM display system by shortening the ELT of the display system, according to a preferred embodiment of the present invention. It is possible that current drivers for the LED may be a limiting factor in the ELT, for example, there may be a limit to the rate of change in the current that the current drivers can provide to the LED during the LED turn off transition. If this is the case, then the light produced by the LED may decrease at a relatively slow rate. Furthermore, the behavior of the LED while being turned off may be unstable or unpredictable. In these situations (and perhaps others), it can be possible to use the light modulator, such as a micromirror, in conjunction with the LED to shorten the ELT. The turn off behavior of the LED can be referred to as being undesirable.

A first trace 205 illustrates micromirror instructions as issued by the binary SLM display system and a second trace 215 illustrates the micromirror state (position) as a function of time. A third trace 305 illustrates LED instructions as issued by the binary SLM display system. The first LED instruction 307 turns the LED off prior to the micromirror assuming the on position.

A fourth trace 505 illustrates LED illumination. A fifth trace 510 illustrates light on the display screen. Although the LED is still on, the light on the display screen begins to drop as the micromirror begins to move away from the "ON" state and then turns off completely when the micromirror moves out of the "ON" state and crosses the threshold where light reflected from the micromirror begins to show on the display screen (shown in the second trace 215 as the horizontal line 219). Since light reflected by the micromirror no longer shows on the display screen, any remaining light from the LED is not reflected on the display screen even if the LED is still outputting light. The ELT of the binary SLM display system is shown as interval 512. Depending upon implementation, the sequence controller may elect to turn off the LED at this point, however, it is not necessary for it to do so.

In addition to having the ability to turn on and off rapidly, the light output of LEDs is often dependent upon a current provided to the LEDs. Therefore, it is possible to increase the intensity of the light produced by the LED (up to a certain limit) or decrease the intensity of light produced by the LED (again, to a certain limit) by changing the magnitude of a current provided to the LED. Furthermore, if a plurality of LEDs are used to provide light for the binary SLM display system, light intensity can be varied by turning on (or off) a certain number of LEDs. For example, if maximum light intensity is desired, then all LEDs in the plurality can be turned on, while for less light intensity, some subset of LEDs in the plurality of LEDs can be turned on.

Figure 6:
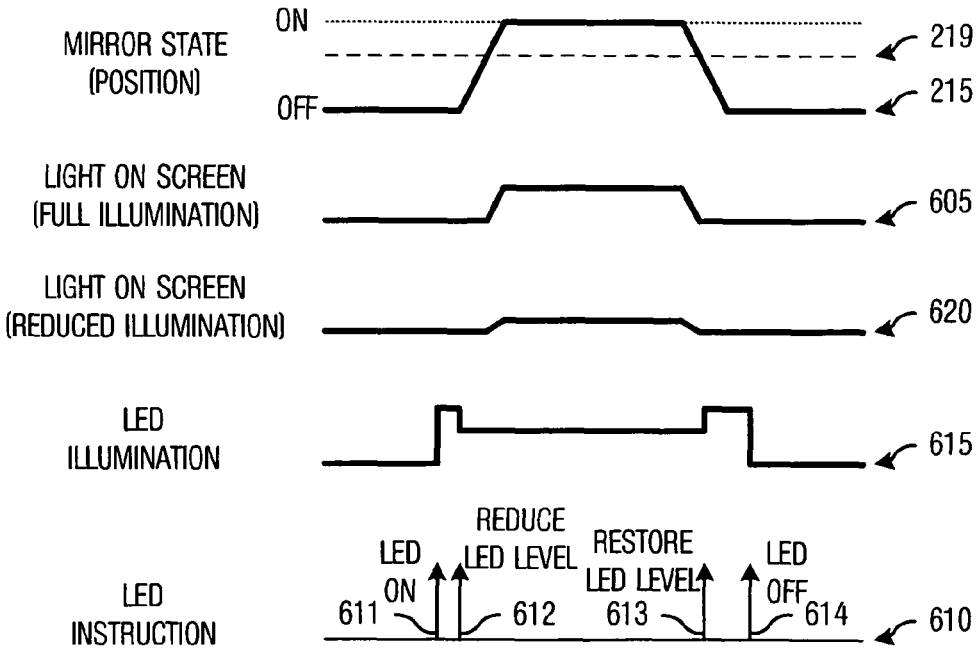
FIG. 6 is a timing diagram of the function of a binary SLM display system, wherein light output intensity is used to change the bit-depth of the binary SLM display system, according to a preferred embodiment of the present invention.

With reference now to FIG. 6, there is shown a diagram illustrating the function of a binary SLM display system, wherein light output intensity of LEDs can be used to change the bit-depth of the binary SLM display system, according to a preferred embodiment of the present invention. As shown in FIG. 6, the diagram illustrates the use of varying LED light output intensity to change the bit-depth of the binary SLM display system. In a situation where a plurality of LEDs are used as a light source, rather than changing LED light output intensity (or in conjunction with) it may be possible to change a number of LEDs turned on (or off) in an array of LEDs. For example, to increase light output intensity, additional LEDs can be turned on, while LEDs can be turned off to decrease light output intensity.

As shown in FIG. 6, a first trace 215 illustrates micromirror state (position) as a function of time and a second trace 605 illustrates light showing on a display screen in a situation wherein the light is from a fully illuminated LED that was turned on while the micromirror was moving from an "OFF" state to an "ON" state and back to an "OFF" state. A third trace 610 illustrates a series of LED instructions to control light output of the LED. A first LED instruction 611 can be used to turn the LED on and a second LED instruction 612 reduces the light output of the LED. It may be possible to turn on an LED at a desired light output, thereby potentially reducing one LED instruction. For example, the first LED instruction 611 may have an argument that specifies a light output level, thereby eliminating the second LED instruction 612. A third LED instruction 613 restores the light output of the LED, while a fourth LED instruction 614 turns off the LED. Again, variations in LED instructions are possible. The actual implementation of the LED instructions are not important in describing the spirit of the present invention.

A fourth trace 615 illustrates LED light output resulting from the execution of the four LED instructions 611, 612, 613, and 614. Finally, a fifth trace 620 illustrates light showing on the display screen with LED light output as shown in the fourth trace 615. As shown in FIG. 6, the light output of the LED was decreased prior to the micromirror moving to a position where light reflected from the micromirror begins to show on the display screen (the position is shown in the first trace 215 as the horizontal line 219). Therefore, the light showing on the display screen is the reduced intensity light output of the LED. Comparing the second trace 605 to the fifth trace 620, the magnitude of the fifth trace 620 is smaller than the magnitude of the second trace 605. The smaller magnitude indicates a lower light intensity.

It can be possible to combine the above discussed techniques to provide a greater degree of flexibility when it comes to reducing the amount of light produced by a binary SLM display system. To further reduce the amount of light, a shortened ELT can be combined with lower LED intensity. For example, if the ELT is shortened by 50% and the LED intensity is also lessened by 50%, then the net amount of light produced is approximately 25% of the amount of light producible within the same display period with full LED intensity. The additional flexibility can enable more possibilities when it comes to scheduling the display of bits in the binary SLM display system. This may lead to positive effects such as longer component life due to less frequent switching of LED state, for example. This is in addition to the positive benefit of greater image quality due to increased bit-depth.

Furthermore, with the technique of varying LED output light intensity, it can be possible to reduce changes to LED state and output light intensity levels by varying display time. Any reduction in the number of times the LED state and/or output light intensity is changed can lead to an increased useful life of the LED. For example, if a minimum display time is 20 micro-seconds and with the LED on at full intensity, it is possible to display 20 units of light, then to display 15 units of light, it is possible to have the LED on at one-half intensity for 30 micro-seconds. If the LED was already set at one-half intensity to display a previous bit, a change in LED output light intensity is saved by using this technique.

Figure 7A:
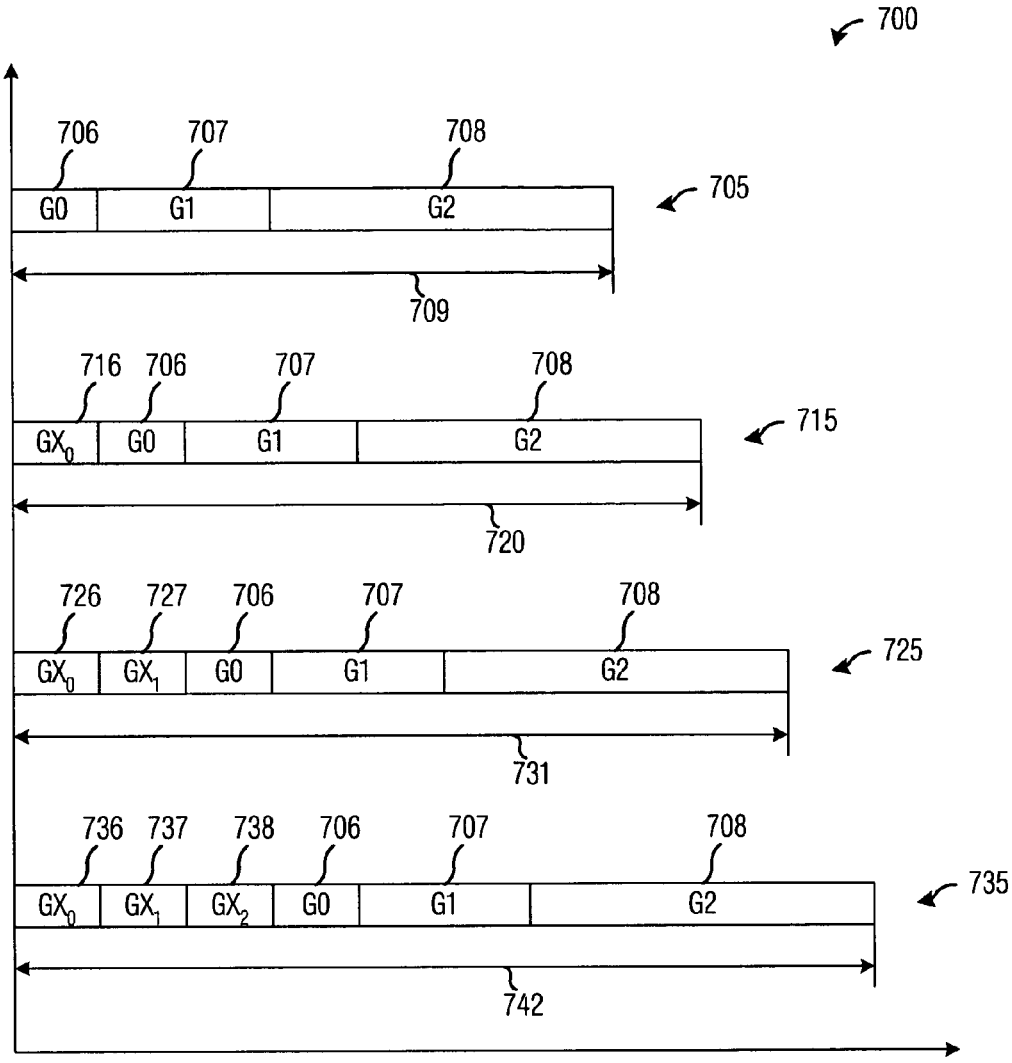
FIGS. 7*a* through 7*c* are timing diagrams illustrating the display of bits in a binary SLM display system, according to a preferred embodiment of the present invention.
Figure 7B:
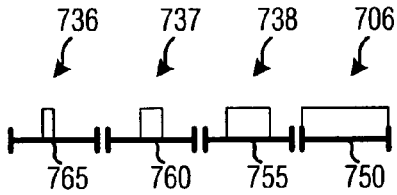
Figure 7C:
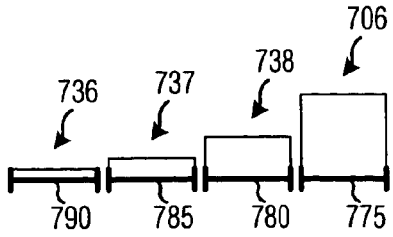

With reference now to FIGS. 7*a* through 7*c*, there are shown diagrams illustrating time used by a light modulator to display bits of a component value of a pixel in an image, according to a preferred embodiment of the present invention. The diagram shown in FIG. 7*a* illustrates an allocation of time to display of the bits of a green component value of a pixel in an image by a binary SLM display system, wherein a variety of bit-depths are used to represent the green component value. Similar allocations of time may be used to display the bits of blue and red components of a pixel in the binary SLM display system. A first trace 705 illustrates the display of the green component value, wherein three bits are used to represent the green component value. Three time intervals are used to display the three bits of the green component value, a first time interval "G0" 706, a second time interval "G1" 707, and a third time interval "G2" 708, with the first time interval "G0" 706 being substantially equal to the minimum display time of the binary SLM display system. A total time required to display the three bits of the green component value is shown as interval 709.

A second trace 715 illustrates the display of the green component value, wherein four bits are used to represent the green component value with a fourth bit ($GX_0$) being used to represent a new least significant bit. The addition of an additional bit can improve image quality, however, since the minimum display time has already been assigned to display the least significant bit of the case where three bits are used to represent the green component value, G0, the display of the fourth bit $GX_0$ cannot be accomplished by simply halving the time used to display the least significant bit G0. Therefore, the time used to display the fourth bit $GX_0$ has to be substantially the same as the time used to display the second least significant bit (G0). A fourth time interval "$GX_0$" 716 displays the time allocated to display the least significant bit "$GX_0$." A total time required to display the four bits of the green component value is shown as interval 720. If the time required to display the four bits of the green component value is greater than a frame time, it may be necessary to scale the time spent on each of the bits (except bits G0 and $GX_0$ since they are already assigned minimum times) so that the overall time is less than or equal to the frame time.

A third trace 725 illustrates the display of the green component value, wherein five bits are used to represent the green component value. The first three bits of the green component value (G0, G1, and G2) are as in the three-bit case with two additional bits $GX_1$ and $GX_0$, where $GX_0$ is the least significant bit. Since the time allocated to display bit G0 is already the minimum display time, the time used to display the two additional bits $GX_1$ and $GX_0$ must also be substantially equal to the minimum display time (shown as intervals 726 and 727). A total time required to display the five bits of the green component value is shown as interval 731. A fourth trace 735 illustrates the display of the green component value with six bits being used to represent the green component value. The first three bits of the green component value (G0, G1, and G2) are as in the three-bit case with three additional bits $GX_2$, $GX_1$, and $GX_0$, again with $GX_0$ being the least significant bit. Again, since the time allocated to display bit G0 is already the minimum display time, the time used to display the three additional bits $GX_2$, $GX_1$, and $GX_0$ must also be substantially equal to the minimum display time (shown as intervals 736, 737, and 738). A total time required to display the six bits of the green component value is shown as interval 742. If the time required to display the five and six bits of the green component value is greater than the frame time, it may be necessary to scale the time spent on each of the bits (except bits G0, $GX_0$, $GX_1$ of the five bit example and bits G0, $GX_0$, $GX_1$, $GX_2$ of the six bit example since they are already assigned minimum times) so that the overall time is less than or equal to the frame time.

A total amount time allowed to display the pixel of an image may be limited by the frame time, which is the amount of time that an image is displayed on the display screen before it is replaced with another image (the replacement image may be the same image). The addition of extra bits may push the total time required to display all of the bits beyond the frame time. Since the frame time is fixed, the total time may need to be shortened to fit within the frame time. However, the minimum display time is fixed, therefore, the time to display the bit G0 and any additional bits, such as $GX_2$, $GX_1$, and $GX_0$ cannot be shortened. Therefore, the time to display the more significant bits, such as bits G1 and G2 may need to be shortened to have the total time fit within the frame time.

As described above, the present invention can permit the light output intensity of the light source of the binary SLM display system (an LED) to be varied or to turn the light source on and off while the light modulator is in an "ON" state, thus the minimum amount of light producible by the binary SLM display system can be reduced. For example, to halve the amount of light produced by the binary SLM display system, it is possible keep the light source on for an equivalent amount of time, but reduce the light output of the light source by two (2), or maintain a constant light output, but keep the light source on for one-half the amount of time.

The diagrams shown in FIGS. 7*b* and 7*c* illustrate two techniques for reducing the minimum amount of light producible by the binary SLM display system. The diagrams display light source behavior for time intervals 736, 737, 738, and 706 from the fourth trace 735 (FIG. 7*a*). The diagram shown in FIG. 7*b* illustrates the technique of maintaining constant light output while shortening the light source on time. Interval 706 represents the display of bit G0, the least significant bit that may be displayed solely via light modulator control. The light source is left on the entire time represented by interval 706 (shown as block 750). Interval 738 represents the display of bit $GX_2$. The bit $GX_2$ is half as significant as bit G0, so the light representing bit $GX_2$ should be one-half the intensity of the light representing bit G0. To accomplish this, the light source is on for one-half of the time represented by interval 738 (shown as block 755). Similarly, bit $GX_1$ is one-quarter as significant as bit G0, so the light representing bit $GX_1$ should be one-quarter the intensity of the light representing bit G0. This is accomplished by having the light source on for one-quarter of the time represented by interval 737 (shown as block 760). The bit $GX_0$ is one-eighth the significance of the bit G0, so the light source is on for one-eighth of the time represented by interval 736 (shown as block 765).

The diagram shown in FIG. 7*c* illustrates the technique of maintaining light source on time while varying light output intensity. Interval 706 represents the display of bit G0, the least significant bit that may be displayed solely via light modulator control. The light source is producing light at a maximum intensity for the entire time represented by interval 706 (shown as block 775). Interval 738 represents the display of bit $GX_2$. The bit $GX_2$ is half as significant as bit G0, so the light representing bit $GX_2$ should be one-half the intensity of the light representing bit G0. To accomplish this, the light source is set to produce light at one-half of maximum intensity for the entire time represented by interval 738 (shown as block 780). Similarly, bit $GX_1$ is one-quarter as significant as bit G0, so the light representing bit $GX_1$ should be one-quarter the intensity of the light representing bit G0. This is accomplished by having the light source set to produce light at one-quarter of maximum intensity for the entire time represented by interval 737 (shown as block 785). The bit $GX_0$ is one-eighth the significance of the bit G0, so the light source is set to produce light at one-eighth of maximum intensity for the entire time represented by interval 736 (shown as block 790).

As discussed above, the two techniques for increasing bit-depth by reducing light output illustrated in FIGS. 7*b* and 7*c* can be combined to provide greater flexibility in light output production. The combination technique can make use of both LED light output intensity modulation and light source on time. For example, to halve the amount of light produced in interval 738 (FIG. 7*c*), the LED light can be turned off for one-half the duration of the interval 738. This will result in halving the light output of the original interval 738.

The discussion of the two techniques for reducing the minimum amount of light produced by the binary SLM display system uses, for discussion purposes, a binary weighting system to assign significance to bits. This should not be construed as limiting the present invention to the use of the binary weighting system. Other weighting systems, including arbitrary and variable weighting systems, can be used in the present invention.

Figure 8A:
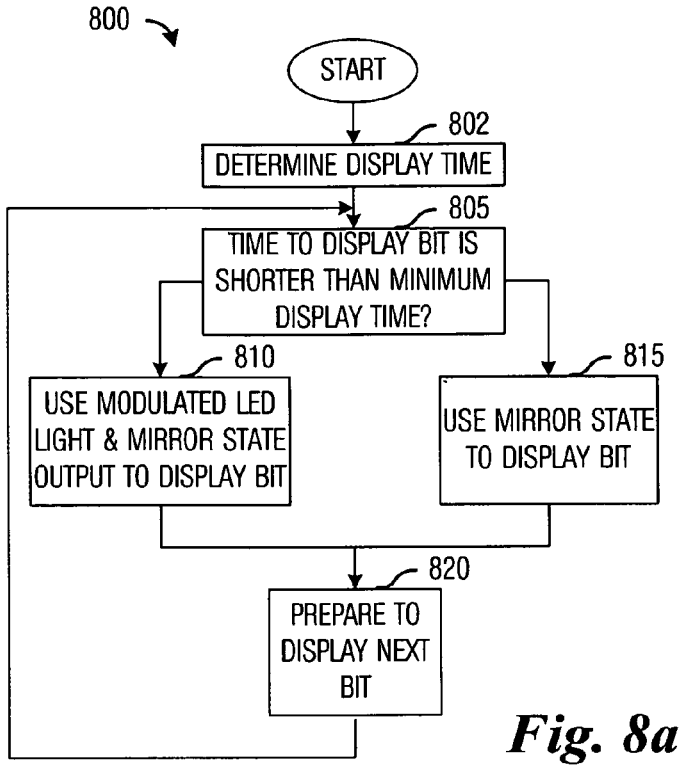
FIGS. 8*a* through 8*e* are diagrams of algorithms for displaying an image in a binary SLM display system, according to a preferred embodiment of the present invention.

With reference now to FIGS. 8*a* through 8*e*, there are shown diagrams illustrating algorithms for displaying an image in a binary SLM display system, according to a preferred embodiment of the present invention. The diagram shown in FIG. 8*a* illustrates an algorithm 800 that can be used to display bits representing RGB component values of pixels of an image. The algorithm 800 illustrates the operations necessary to display bits for a single RGB component value, such as red, green, or blue. However, the operations for displaying the other component values are similar. According to a preferred embodiment of the present invention, the algorithm 800 may execute in a sequence controller (not shown) located in the binary SLM display system. Alternatively, the algorithm 800 may be implemented in an instruction compiler that generates instruction sequences to handle specific situations that may arise in the operation of the binary SLM display system. The instruction compiler may generate different instruction sequences that are to be used when specific situations arise. For example, if the time to display a bit is less than the minimum display time of the binary SLM display system, then use a first sequence of instructions, else use a second sequence of instructions. In such a situation, the sequence controller may have limited processing capabilities and may simply have the capability to execute instructions provided to it. The discussion below describes the operation of a sequence controller that is capable of making decisions regarding the instructions that it issues. However, with minor changes, the algorithms presented can be applied to an instruction compiler used to pre-generate instruction sequences.

The sequence controller may be responsible for scheduling binary SLM display system control instructions, executing instructions for providing the component bit values to the light modulators (such as the micromirrors), controlling the state of the light source, controlling the light output intensity of the light source, resetting the light modulators, and so forth. The sequence controller can further enhance the operation of the binary SLM display system, by optimizing the scheduling of control instructions to minimize LED light state changes, for example. The sequence controller may be a custom designed integrated circuit, a micro-controller, a general purpose processor, or so on. The sequence controller can begin with a bit of a component value of a pixel in an image that it is to display. The order in which the bits of the component value are displayed in the binary SLM display device can have an impact upon the image quality, therefore, the sequence controller may be programmable to allow custom ordering of bits. Upon selecting the bit to be displayed, the sequence controller can determine a display time for the bit (block 802). The computation of the display time can be dependent upon a weight of the bit, a desired LED light output intensity, a minimum display time, and so forth. With a given weight of the bit, it can be possible to fix the desired LED light output intensity and compute a display time or fix a display time and then compute an LED light output intensity. To normalize display time computations and to simplify comparisons, the display time computations may be for a single LED light output intensity, such as with maximum intensity.

The sequence controller can then determine if the time required to display the bit (the display time) is shorter than the binary SLM display system's minimum display time (block 805). As discussed earlier, the minimum display time can be a physically limited time duration that corresponds to a minimum amount of time that it takes for the binary SLM display system's light modulator to switch from an "OFF" state to an "ON" state and back to an "OFF" state or it may be a value specified by a designer of the binary SLM display system. The minimum display time can translate to a minimum amount of light that can be displayed on a display screen for a single LED light output intensity. Without resorting to the use of additional hardware, such as neutral density filters or dynamic apertures, it may not be possible to put less light on the display screen.

One way to determine a bit's display time is to use a binary weighting of the bits. Again, the discussion of the use of the binary weighting system is for discussion purposes only and is not intended to limit the present invention. For example, if the least significant bit is assigned a weight of one (1), then the next bit can be assigned a weight of two (2), and so on. One of the bits in the component value will be assigned a display time that is substantially equal to the minimum display time. Then, using a ratio of the weight of a bit to be displayed with the weight of the bit with the display time that is substantially equal to the minimum display time, the display time of the bit to be displayed can be computed. For example, if the bit to be displayed has a weight of two (2) and the bit with the display time substantially equal to the minimum display time has a weight of eight (8), then the display time of the bit to be displayed is ⅜*minimum display time=¼ of the minimum display time. The display times may be pre-computed and stored for rapid access.

If the time required to display the bit is less than the minimum display time, then the sequence controller can make use of light modulating techniques enabled by the use of a rapid switching light source, such as an LED, to display the bit (block 810). Detailed discussions of several such techniques are presented below. If the time required to display the bit is substantially equal to or greater than the minimum display time, then the sequence controller can make use of light modulator state to display the bit (block 815). In order to display a bit whose required display time is equal to or greater than the minimum display time, the sequence controller may simply provide the value of the bit to light modulator, issue an instruction to have the light modulator assume the value of the bit, and then after the required display time has expired, issue another instruction to reset the light modulator. Since there may be a time delay in between the issuance of an instruction to the light modulator, the actual time of the issuance of an instruction and the required display time may not be equal. Once the bit has been displayed, the sequence controller can prepare to display another bit of the component value of the pixel (block 820).

Figure 8B:
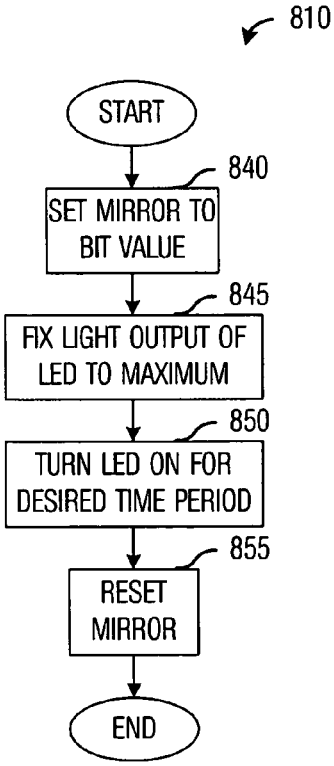

The diagram shown in FIG. 8*b* illustrates a technique that can use both modulation of light from the light source and a light modulator's state to display a bit, wherein a light on time is varied to change the amount of light displayed on the display screen. The technique may be an implementation of block 810 of the algorithm 800 (FIG. 8*a*). Since the light modulator cannot be used to further reduce the light displayed on the display screen (due to the minimum display time), further reduction of the light displayed on the display screen may arise from modulating the light from the light source itself. The sequence controller can begin by providing the value of the bit to the light modulator (block 840). This may involve the writing of the bit value to a memory location associated with the light modulator.

The providing of the bit value to the light modulator may initiate a change of state of the light modulator or an additional instruction may be needed to initiate the change of state of the light modulator. Then, the sequence controller can issue an instruction to configure the light source to produce light at a maximum intensity (block 845). The maximum intensity light level may not be the light source's maximum light output, but it may be a maximum calibrated light level set during configuration. Once the light modulator has changed to a state corresponding to the bit value, the sequence controller may then issue a command to turn on the light source (block 850) and after the desired amount of time, the sequence controller may issue another command to turn off the light source. Alternatively, the command to turn on the light source may have an argument specifying a period of time that the light source is to remain on. Once the light source is off, the sequence controller can issue a command to reset the light modulator (block 855).

Figure 8C:
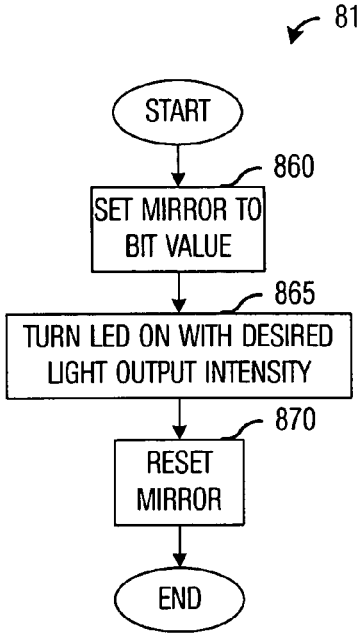

The diagram shown in FIG. 8*c* illustrates a technique that can use both modulation of light from the light source as well as a light modulator's state to display a bit, wherein light output intensity is varied to change the amount of light displayed on the display screen. The technique may be an implementation of block 810 of the algorithm 800 (FIG. 8*a*). Rather than switching the light source on and off for a duration that is less than the minimum display time as described in FIG. 8*b*, it can be possible to reduce the light output of the light source. The sequence controller can begin by providing the value of the bit to the light modulator (block 860). This may involve the writing of the bit value to a memory location associated with the light modulator.

The providing of the bit value to the light modulator may initiate a change of state of the light modulator or an additional instruction may be needed to initiate the change of state of the light modulator. Then, the sequence controller can issue an instruction to turn on the light source with a specified light output intensity (block 865). The specified light output intensity can be computed in a manner similar to the technique discussed for computing display time. For example, if the light source is an LED, it can be possible to change the light output intensity of the LED by changing a current provided to the LED. Alternatively, if the light source is a plurality of LEDs, it can be possible to change the light output intensity by turning on a specified number of LEDs. After the expiration of the minimum display time, the sequence controller may issue a command to reset the light modulator (block 870).

Figure 8D:
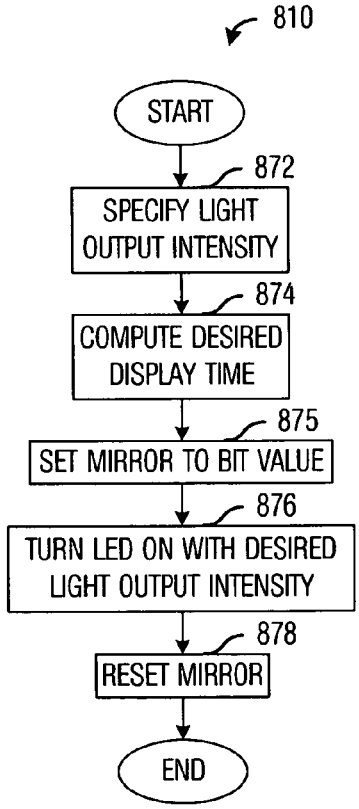

The diagram shown in FIG. 8*d* illustrates a variation of the technique described in FIG. 8*c*, wherein it is possible that a desired LED light output intensity is specified prior to a computation of a desired display time. Depending upon the desired LED light output intensity, the desired display time may actually be longer than the minimum display time of the binary SLM display system. For example, if the minimum display time for a binary SLM display system is 20 micro-seconds, then for a maximum LED light output intensity, the binary SLM display system can display 20 units of light. If it is desired to display 15 units of light, then if the desired LED light output intensity is 75%, then the desired display time is 20 micro-seconds. However, if the desired LED light output intensity is 50%, then the desired display time is 30 micro-seconds. A reason for specifying the desired LED light output intensity is that if the LED was already on with the desired LED light output intensity, then the bit can be displayed without changing the LED light output intensity, which may result in a longer useful lifespan for the LED. However, if the desired display time is less than the minimum display time, then the technique described in FIG. 8*c* will need to be used. The sequence controller will know which technique to use since it knows the LED light output intensity. If the LED light output intensity is at a maximum, then the technique described in FIG. 8*c* will be used. Only if the LED light output intensity is below some known value (such as 75% in the above example) can the technique described in FIG. 8*d* be used.

The sequence controller can begin by specifying a desired LED light output intensity (block 872). The desired LED light output intensity may be equal to a current LED light output intensity. The sequence controller can the compute a desired display time (block 874) based upon the desired LED light output intensity. With the desired display time computed, the sequence controller can begin by providing the value of the bit to the light modulator (block 875). This may involve the writing of the bit value to a memory location associated with the light modulator. The providing of the bit value to the light modulator may initiate a change of state of the light modulator or an additional instruction may be needed to initiate the change of state of the light modulator. Then, the sequence controller can issue an instruction to turn on the light source with a specified light output intensity (block 876). The specified light output intensity can be computed in a manner similar to the technique discussed for computing display time. For example, if the light source is an LED, it can be possible to change the light output intensity of the LED by changing a current provided to the LED. Alternatively, if the light source is a plurality of LEDs, it can be possible to change the light output intensity by turning on a specified number of LEDs. After the expiration of the desired display time, the sequence controller may issue a command to reset the light modulator (block 878).

Figure 8E:
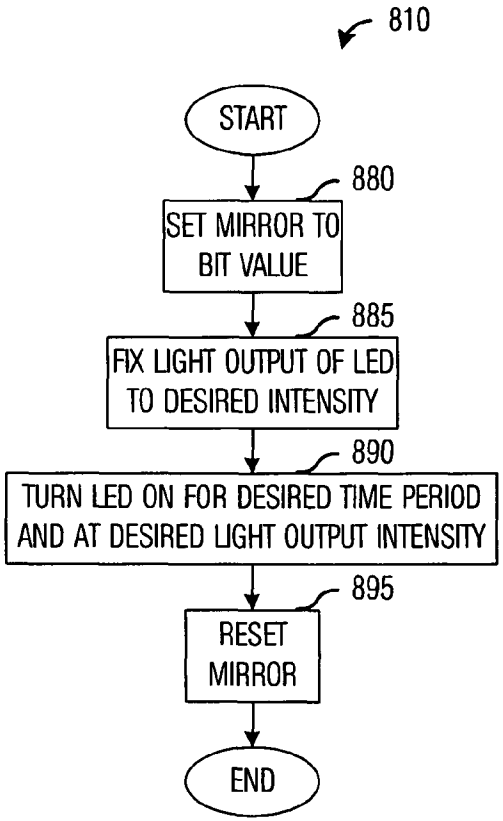

The diagram shown in FIG. 8*e* illustrates a combination technique that modulates light from the light source to display a bit by varying the light on time and the light output intensity as well as a light modulator's state to change the amount of light displayed on the display screen. The technique may be an implementation of block 810 of the algorithm 800 (FIG. 8*a*). Rather than just switching the light source on and off for a duration that is less than the minimum display time and reducing the light output of the light source, the technique does both. The sequence controller can begin by providing the value of the bit to the light modulator (block 880). This may involve the writing of the bit value to a memory location associated with the light modulator.

The providing of the bit value to the light modulator may initiate a change of state of the light modulator or an additional instruction may be needed to initiate the change of state of the light modulator. Then, the sequence controller can issue an instruction to configure the light source to produce light at a desired intensity (block 885). The desired intensity light level of the light source may be multiple output light levels. Once the light modulator has changed to a state corresponding to the bit value, the sequence controller may then issue a command to turn on the light source (block 890) and after the desired amount of time, the sequence controller may issue another command to turn off the light source. Alternatively, the command to turn on the light source may have an argument specifying a period of time that the light source is to remain on. Once the light source is off, the sequence controller can issue a command to reset the light modulator (block 895).

The technique described in FIG. 8*e* makes use of the light intensity modulation technique described in FIG. 8*c*, wherein the LED light output intensity is computed based upon the minimum display time of the binary SLM display system. However, the technique can be readily modified to use the technique described in FIG. 8*d*, wherein a desired display time is computed based upon a desired LED light output intensity, by persons of ordinary skill in the art of the present invention.

Figure 9:
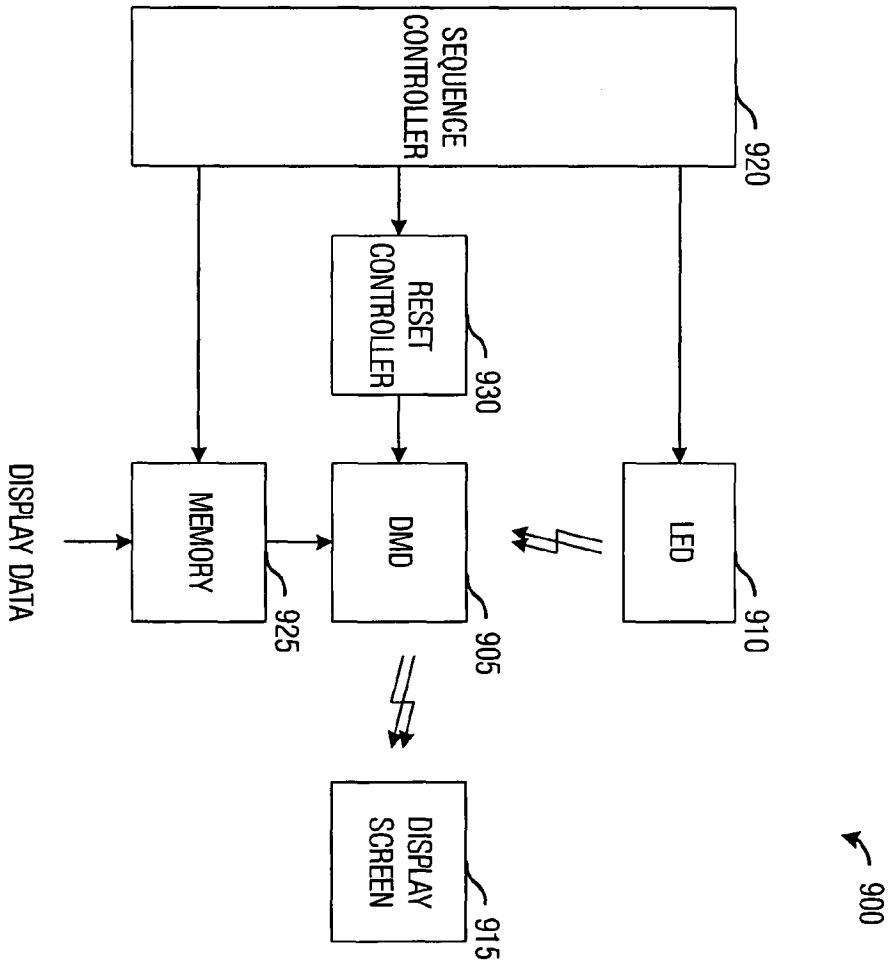
FIG. 9 is a diagram of a portion of a binary SLM display system, according to a preferred embodiment of the present invention.

With reference now to FIG. 9, there is shown a diagram illustrating a portion of a binary SLM display system 900, according to a preferred embodiment of the present invention. As shown in FIG. 9, the portion of the binary SLM display system 900 includes a spatial light modulator 905, such as a digital micromirror device (DMD) array, and a rapid switching light source 910. In addition to micromirrors, other light modulator technology, such as liquid crystal, liquid crystal on silicon, deformable mirrors, actuated mirrors, and so forth, can be used in the spatial light modulator 905. The rapid switching light source 910 should be able to switch from on to off and off to on at a faster rate than the light modulators in the spatial light modulator 905 are capable of changing state. The rapid switching light source 910 may be a single LED or an array of LEDs. The array of LEDs may be made up of LEDs of a single color or differently colored LEDs may be used. Furthermore, the rapid switching light source 910 is capable of producing light at various intensities. Light from the rapid switching light source 910 reflects from the spatial light modulator 910 and onto a display screen 915.

A sequence controller 920 can provide instructions to the rapid switching light source 910 to control LED state. The sequence controller 920 can also access a memory 925, which can contain the data (pixel information) of images to be displayed via the spatial light modulator 905. A reset controller 930, also controlled by instructions provided by the sequence controller 920, places the spatial light modulator 905 into a mode that allows it to accept new state change instructions from the sequence controller 920.

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for displaying a bit in a spatial light modulator display system, the method comprising:

determining a display time for the bit based upon a weighting of the bit; and displaying the bit in response to the determination using:

a light modulator in a first case when the display time is substantially equal to or greater than a predetermined display time, wherein a light source remains in an active state during a period in which the bit is displayed in the first case; and the light modulator and light source modulation in a second case when the display time is less than the predetermined display time, wherein the period in which the bit is displayed in the second case is initiated by the light source entering an active state while the light modulator is in a state corresponding to a value of the bit, or terminated by the light source entering an inactive state while the light modulator is in a state corresponding to a value of the bit, or both.

2. The method of claim 1, wherein displaying in the first case comprises:

setting the light modulator to the state corresponding to a value of the bit; and resetting the light modulator after a time substantially equal to the display time elapses.

3. The method of claim 1, wherein displaying in the second case using comprises:

setting the light modulator to the state corresponding to the value of the bit; and inactivating the light source after a time substantially equal to the display time has elapsed while the modulator is in the state corresponding to the value of the bit with the light source on.

4. The method of claim 3, resetting the light modulator after a time substantially equal to the predetermined display time has elapsed after the setting, wherein the bit is one bit in a plurality of bits, wherein the predetermined display time is a display time for a reference bit in the plurality of bits, and wherein the display time is substantially equal to the predetermined display time multiplied by a ratio of the weight of the bit to the weight of the reference bit.

5. The method of claim 3, wherein the light source has an undesirable increase in light intensity behavior, wherein the light source is in an active state prior to the light modulator assuming the state, and wherein the inactive state occurs after the time substantially equal to the display time has elapsed since the setting.

6. The method of claim 3, wherein the light source has an undesirable decrease in light intensity behavior, wherein the light source is activated at a time, and wherein an elapsed time between the time and the elapsing of the predetermined display time since the setting is substantially equal to the display time.

7. The method of claim 1, wherein the second using comprises:

setting the light modulator to the state corresponding to the value of the bit;

computing a light output intensity;

setting the light source with a light output intensity set at the computed light output intensity; and resetting the light modulator after a time substantially equal to the predetermined display time has elapsed since the setting of the light source.

8. The method of claim 7, wherein the bit is one bit in a plurality of bits, wherein the predetermined display time is a display time for a reference bit in the plurality of bits, and wherein the light output intensity is computed as a product of a maximum light output intensity with a ratio of a weight of the bit to a weight of the reference bit.

9. The method of claim 7, wherein the bit is one bit in a plurality of bits, wherein the predetermined display time is a display time for a reference bit in the plurality of bits, and wherein the light output intensity is computed as a product of a minimum, non-zero, light output intensity with a ratio of a weight of the reference bit to a weight of the bit.

10. The method of claim 1, wherein the second using comprises:

computing a desired display time based on a desired light output intensity;

activating the light source with a light output intensity set at the desired light output intensity; and resetting the light modulator after a time substantially equal to the desired display time has elapsed since the setting of the light source.

11. The method of claim 1, wherein the bit is one bit in a plurality of bits, and wherein the determining, the first using, and the second using are repeated for each bit in the plurality.

12. The method of claim 1, wherein the second using comprises:

setting the light modulator to the state corresponding to the value of the bit;

computing a light output intensity;

computing a display time enabling setting the light source with a light output intensity set at the computed light output intensity;

disabling the light source after a time substantially equal to the display time has elapsed; and resetting the light modulator after a time substantially equal to the predetermined display time has elapsed after the setting of the light modulator.

13. The method of claim 12, wherein the display time and the light output intensity are computed based upon a desired light output.

14. The method of claim 12, wherein a measurement of the elapsed time for disabling the light source begins with the setting of the light source.

15. The method of claim 1, wherein the second using comprises:

computing a desired display time based on a desired light output intensity;

setting the light modulator to the state corresponding to the value of the bit;

setting the light source with a light output intensity set at the desired light output intensity;

disabling the light source after a time substantially equal to the desired display time has elapsed; and resetting the light modulator after a time substantially equal to the greater of the predetermined display time or the desired display time has elapsed after the setting of the light modulator.

16. A system for displaying video images, the system comprising:

a spatial light modulator comprising an array of individual light modulators, the spatial light modulator configured to create images comprising pixels by setting each individual light modulator in the array to a state matching a corresponding pixel value;

a rapid switching light source to optically illuminate the spatial light modulator; and a controller concurrently modulating both the rapid switching light source and the spatial light modulator to generate an actual image display time for the pixel value, wherein the actual display time is begun by enabling the rapid switching light source while the light modulator is in a state corresponding to a value of the bit, or the actual display time is ended by disabling the rapid switching light source while the light modulator is in a state corresponding to a value of the bit, or the actual display time is both begun by enabling the rapid switching light source while the light modulator is in a state corresponding to a value of the bit and ended by disabling the rapid switching light source while the light modulator is in a state corresponding to a value of the bit.

17. The system of claim 16, wherein the rapid switching light source is capable of producing light at various intensities.

18. The system of claim 16 further comprising a display screen to display the images reflected from the spatial light modulator.

19. The system of claim 16, wherein the spatial light modulator comprises an array of micromirrors.

20. The system of claim 16, wherein the spatial light modulator comprises an array of deformable mirrors.

21. The system of claim 16, wherein the rapid switching light comprises a light-emitting diode.

22. The system of claim 21, wherein the rapid switching light comprises a plurality of light-emitting diodes.

23. The system of claim 22, wherein the rapid switching light comprises different colored light-emitting diodes.

* * * * *